US005660322A

United States Patent [19]

Jensen

[11] Patent Number: 5,660,322

[45] Date of Patent: Aug. 26, 1997

[54] BARRIER PACKAGE FOR INSTANT FILM

[75] Inventor: Kurt D. Jensen, Newburgh, N.Y.

[73] Assignee: International Paper, Purchase, N.Y.

[21] Appl. No.: 521,487

[22] Filed: Aug. 30, 1995

[51] Int. Cl.[6] ..... B65D 5/06; B65D 5/42

[52] U.S. Cl. ..... 229/193; 206/455; 206/806; 229/103.2; 229/245

[58] Field of Search ..... 229/103.2, 193, 229/208, 245, 247; 206/455, 456, 806

[56] References Cited

U.S. PATENT DOCUMENTS

| | | | |
|---|---|---|---|
| 1,687,678 | 10/1928 | Mallory . | |
| 2,936,940 | 5/1960 | Berghgracht . | |
| 2,963,215 | 12/1960 | Saidel et al. | 206/45.31 |
| 2,984,401 | 5/1961 | Herkender . | |
| 3,083,890 | 4/1963 | Ignell | 229/193 |
| 3,085,736 | 4/1963 | Meyers | 229/193 |
| 3,100,597 | 8/1963 | Saidel et al. | 229/245 |
| 3,484,036 | 12/1969 | Meyers | 229/193 |
| 3,507,442 | 4/1970 | Van Dam . | |
| 3,625,411 | 12/1971 | Cote . | |
| 3,829,002 | 8/1974 | Kleinhaut . | |
| 4,266,671 | 5/1981 | Roccaforte . | |
| 4,279,376 | 7/1981 | Roccaforte . | |
| 4,291,807 | 9/1981 | Giordan et al. | 229/193 |
| 4,331,240 | 5/1982 | Vanasse . | |
| 4,867,372 | 9/1989 | Patterson | 229/247 |
| 4,876,125 | 10/1989 | Akao et al. | 206/455 |
| 4,949,845 | 8/1990 | Dixon | 206/806 |
| 5,083,700 | 1/1992 | Mello . | |
| 5,356,069 | 10/1994 | Bochet . | |
| 5,358,174 | 10/1994 | Antezak . | |
| 5,377,835 | 1/1995 | Cornelissen et al. | 206/455 |
| 5,437,406 | 8/1995 | Gordon et al. | 229/193 |

*Primary Examiner*—Gary E. Elkins
*Attorney, Agent, or Firm*—Michael J. Doyle

[57] ABSTRACT

A carton for a package of photographic film, such as instant film. The carton is formed of a unitary paperboard blank coated on both sides by a thermoplastic barrier film. The thermoplastic functions as an adhesive when acted upon by heat and pressure, thus sealing portions of the blank together. Each of four corners of the carton includes a gusset folded in such a manner as not to present a raw paperboard edge to the interior. The construction yields an air tight, liquid tight package with an oxygen barrier, and obviates the requirement of many similar packages that the photographic film be separately wrapped in a protective foil or film prior to being placed in a carton. Three embodiments of the carton are disclosed.

6 Claims, 6 Drawing Sheets

FIG. 2
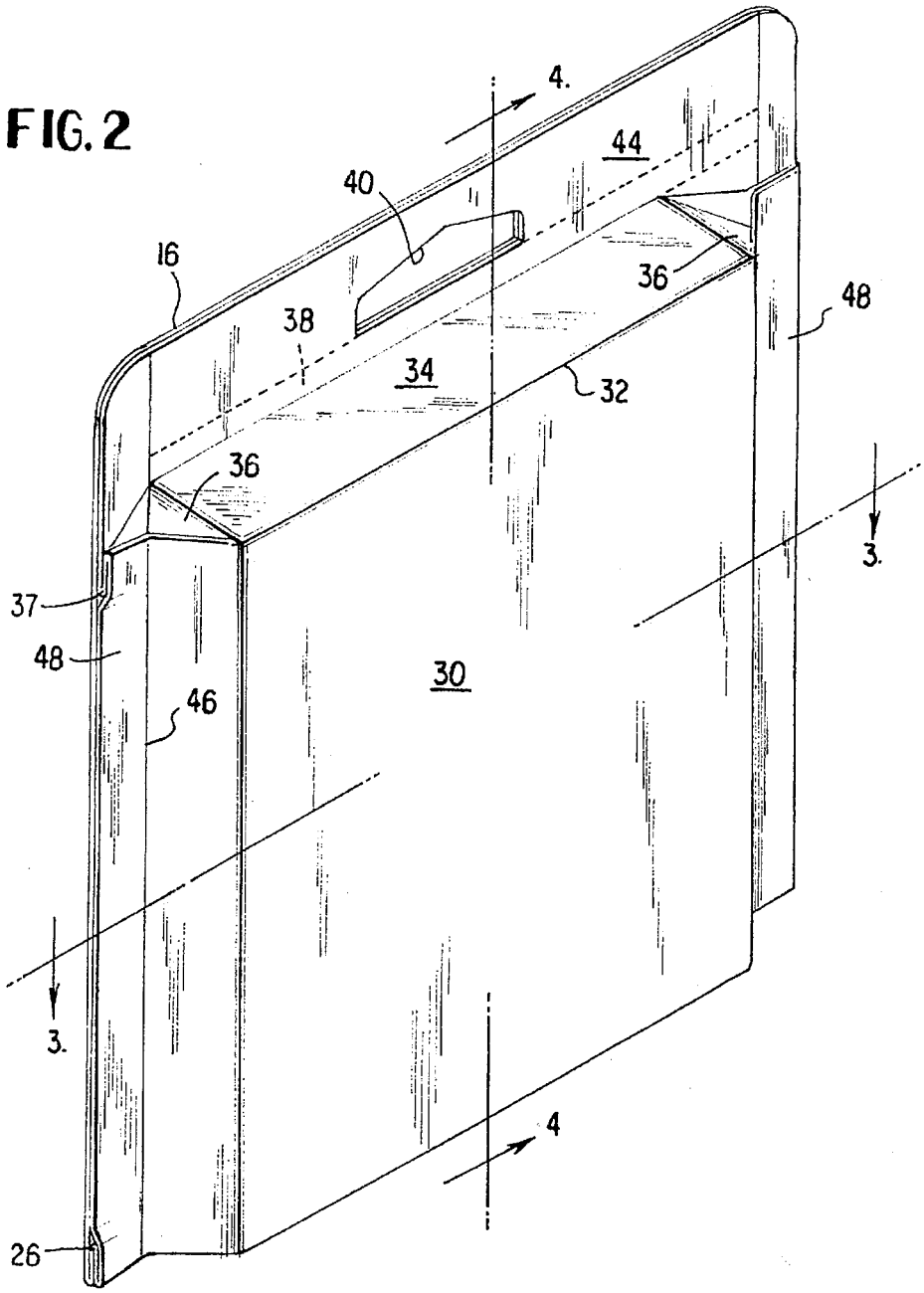
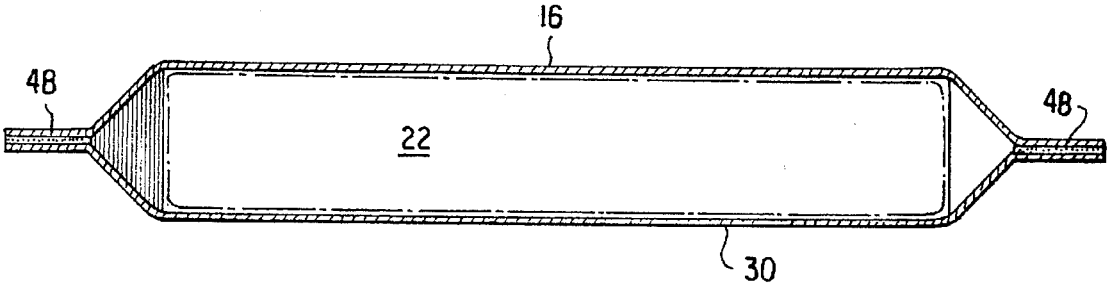
FIG. 3

FIG. 7
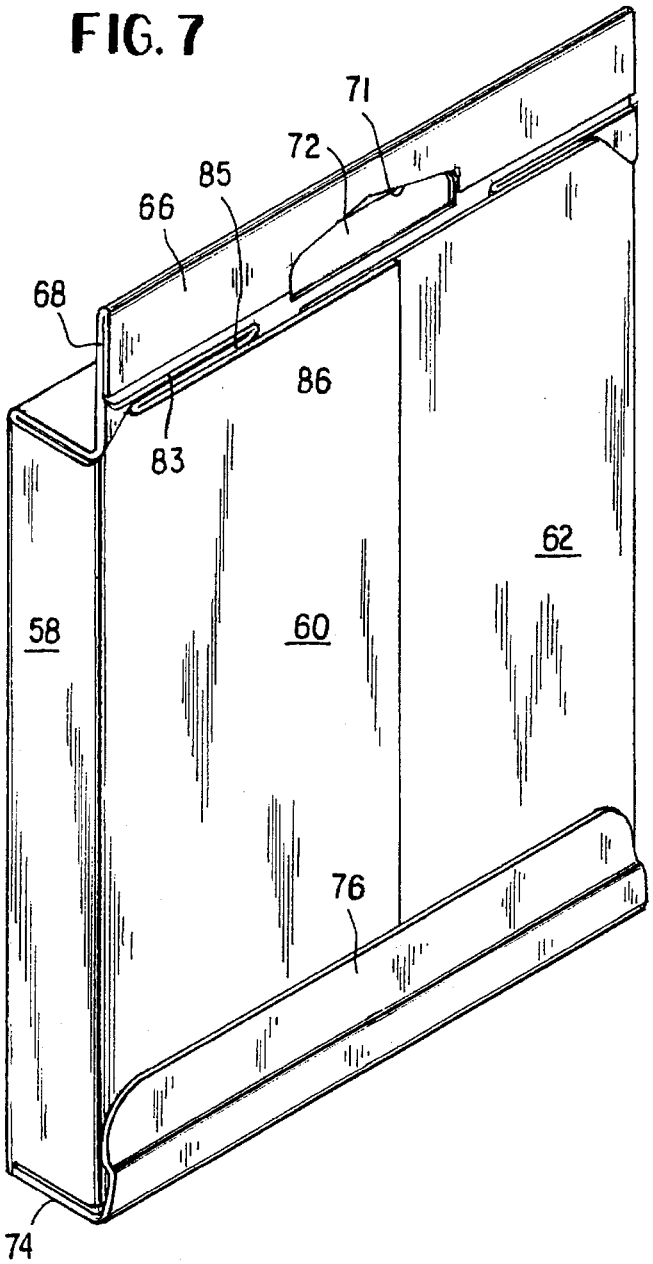
FIG. 8
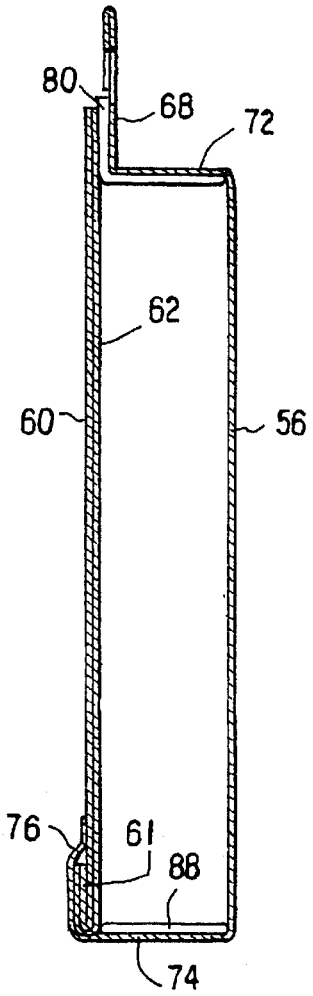
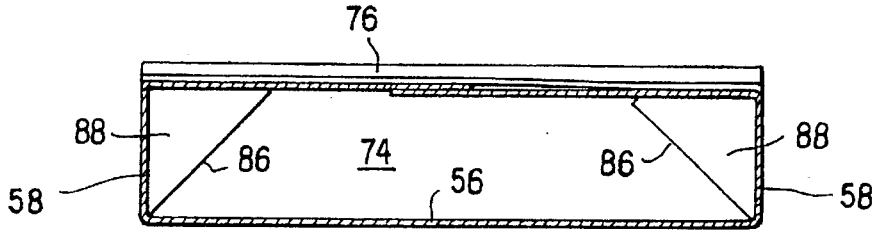
FIG. 9

FIG. 12
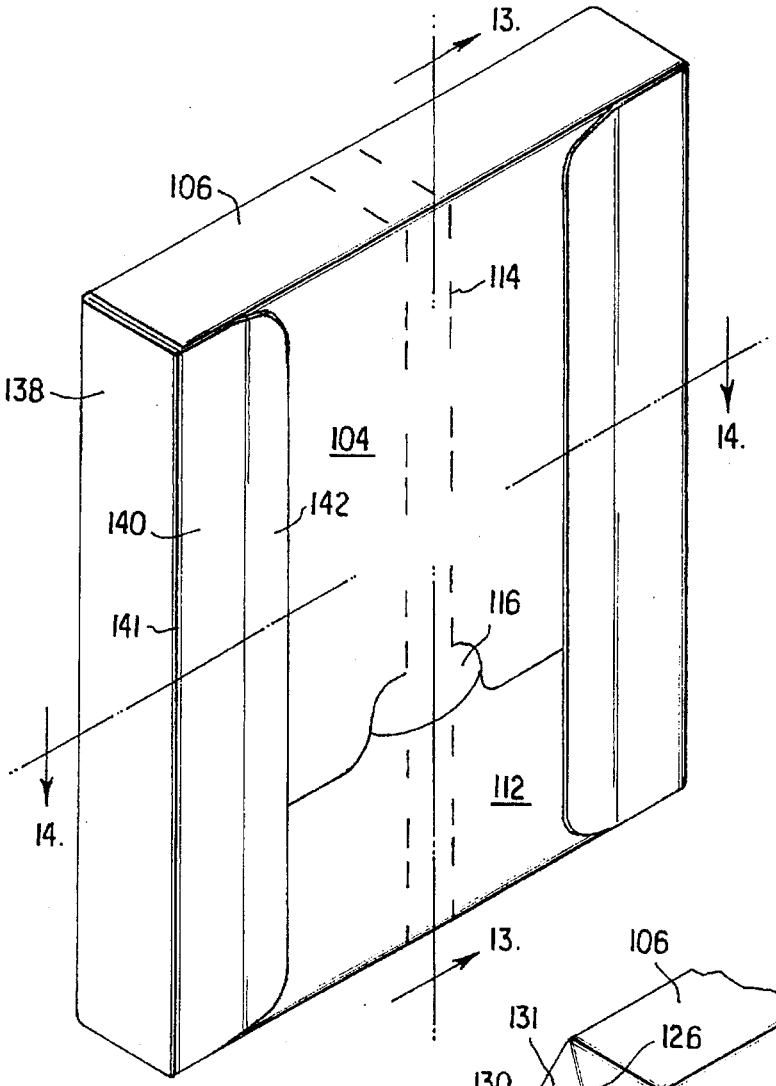
FIG. 13
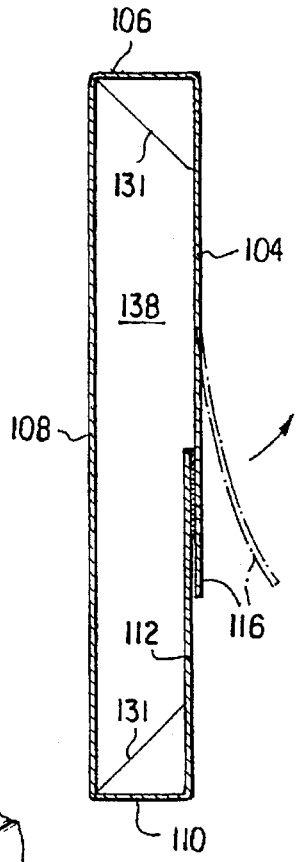
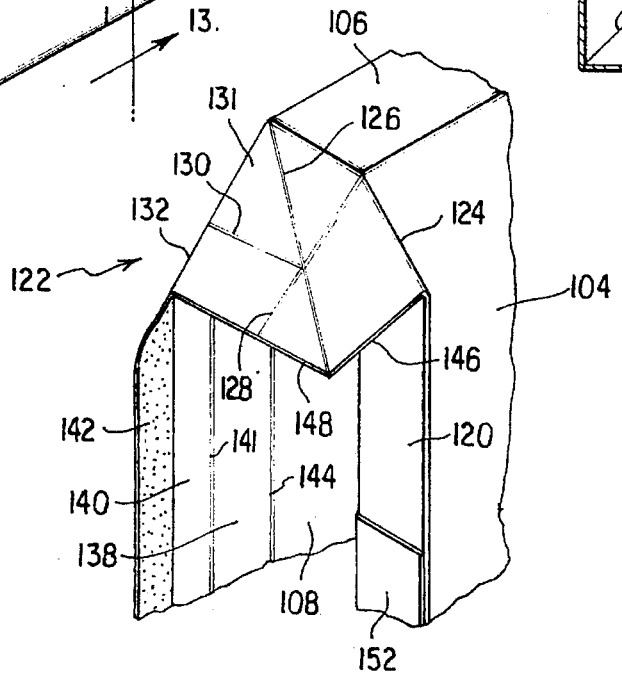
FIG. 11

BARRIER PACKAGE FOR INSTANT FILM

BACKGROUND OF THE INVENTION

This invention relates to paperboard containers and more particularly to containers for forming packages of photographic film. While a variety of paperboard containers are known for the retail packaging of photographic film, such as instant film cartridges, there still exists the need for an airtight, light tight carton with an oxygen barrier. Some cartons presently in use for this purpose require three different components of two different materials, resulting in the requirement of lengthy assembly times.

SUMMARY OF THE INVENTION

According to the practice of this invention, a barrier package for instant film is formed from a unitary blank of paperboard. The blank is coated with a barrier coating, such as polyethylene-foil-polyethylene, or any other known multilayer barrier coating including an external thermoplastic film to enable portions of the blank (in each of the embodiments) to be adhered together in surface contact by the application of heat and pressure by virtue of local partial melting of the thermoplastic coating. Pouch styles and folding carton styles are disclosed, with the pouch style being converted into a side seamed tube by doubling the blank over and sealing it at a hang tab. This is important because it eliminates the need for skiving and hemming to eliminate raw board edges. The top half of the hanger is not sealed to itself so as to provide means of separating the edges of the two plies in order to delaminate the pouch walls and permit the user to gain access to the film. The folding carton style container employs angle gussets to seal off the ends of the carton. Similar to the top of a gable top carton for liquids, no raw board edges are exposed to the interior of the package. The construction includes gussets which are made such that the resulting fin seal can be folded over flat to create a flat bottom package. The top fin seal is designed so that it is folded up to create a hang tab for retail display. Many presently used packages for instant film require film membranes to seal off the ends of the cartons. The application of this sealing film is slow and costly. The practice of the present invention eliminates the need for this film seal.

BRIEF DESCRIPTION OF THE DRAWINGS

FIGS. 1–4 illustrate a first embodiment of the invention, with FIG. 1 being a plan view of a unitary blank of paperboard from which the carton is fashioned. FIG. 2 is a perspective view illustrating the complete carton with film therein (the latter not shown), while FIGS. 3 and 4 are the indicated sectional views taken from FIG. 2.

FIGS. 5–9 illustrate a second embodiment of the invention, with FIG. 5 being a plan view of a unitary blank of paperboard from which the carton is formed. FIGS. 6 and 7 are perspective views of the carton according to this second embodiment of the invention, while FIGS. 8 and 9 are sectional views taken as indicated at FIG. 6.

FIGS. 10–14 show a third embodiment of the invention, with FIG. 10 being a plan view of a unitary blank of paperboard from which the carton of this embodiment is fashioned. FIG. 11 illustrates an intermediate bent configuration of the blank during carton erection. FIG. 12 is a perspective view of the completed carton with film (not illustrated) therein, while FIGS. 13 and 14 are sectional views taken as indicated at FIG. 12.

DETAILED DESCRIPTION OF THE INVENTION

Figure 1:
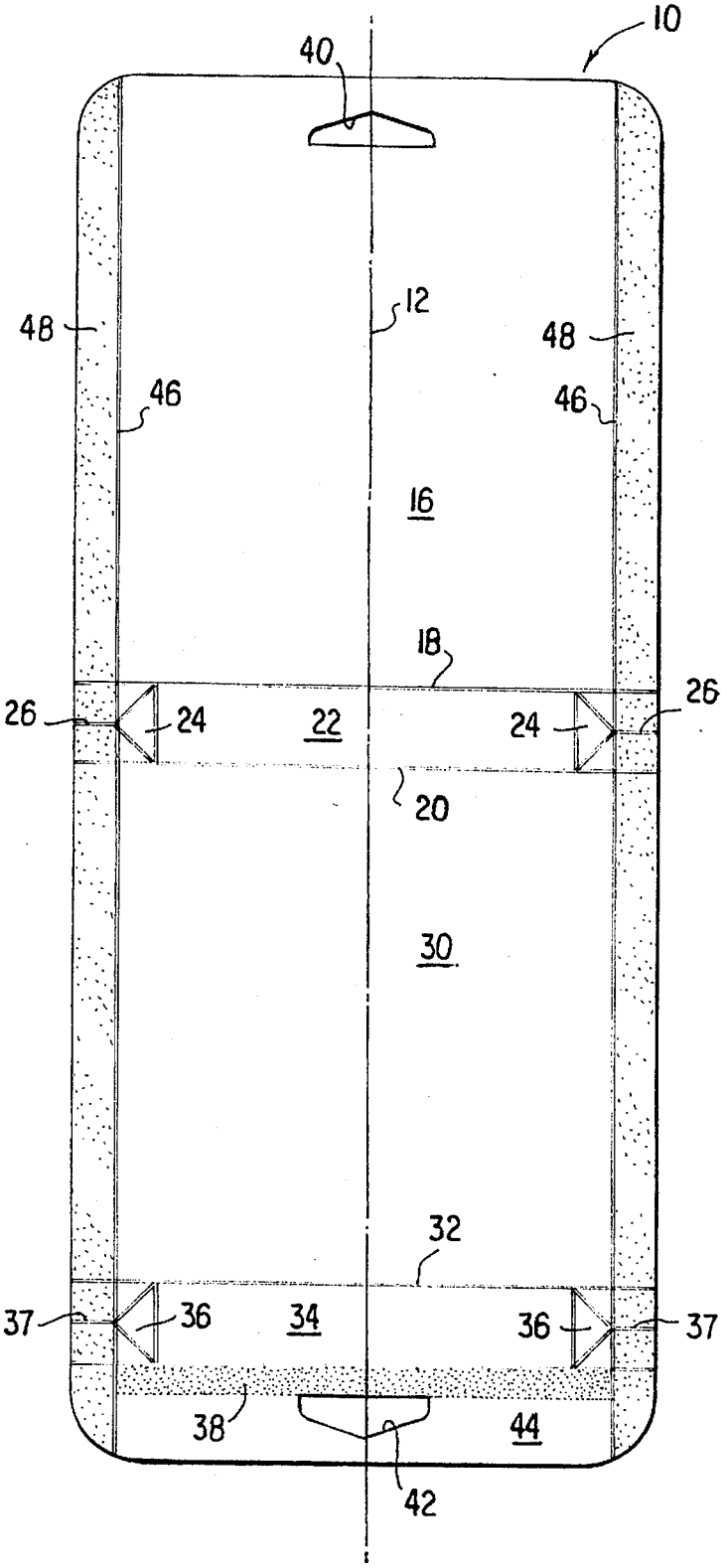

Referring now to FIG. 1, a unitary blank of paperboard, designated as 10, is shown and is in the general form of a rectangle. Vertical extending axis 12 divides right and left halves of the blank into mirror symmetrical halves. From the top down, several panels are designated as 16, 22, 30, 34, and 44. Horizontal score lines 18 and 20 define panel 22, with indicated vertical and slanted score lines defining triangular portions 24, one apex of each of which terminates at one end of the horizontal fold line 26. The lower end of panel 30 terminates at horizontal fold line 32, with panel 34 positioned below it. Triangular elements 36, defined by the indicated fold and score lines, each have an apex which touches one end of horizontal fold lines 37 at the peripheries of the blank, similar to horizontal lines 26. A horizontal zone 38, shown as stippled, indicates a glue area. Lowermost panel 44 is immediately beneath stippled area 38. Openings 40 and 42 are adapted to be aligned for hanging on a hook. Vertical score lines 46 are spaced from respective right and left vertical free edges of the blank and define, with the free edges, side or edge areas 48 (stippled) which are adapted to be glued together to form fins.

Figure 4:
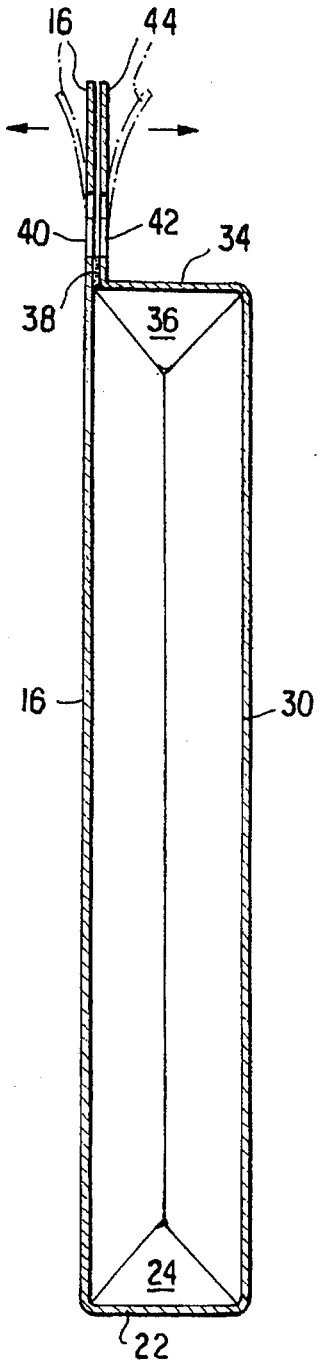

To form the carton of FIG. 2 from blank 10, the blank is folded about horizontal fold lines 18 and 20 such that panels 16 and 30 are essentially parallel. Panel 34 is bent along fold line 32, so that panel 34 is essentially in a horizontal plane, as shown at FIG. 2. The bottom and sides of the lower half of blank 10 are seen to be folded up against complementary portions of the upper half of the blank, with FIG. 2 indicating the location of adhesive area 38 relative to aligned openings 40 and 42. It is seen that the two main panels 16 and 30 are in parallelism, with the film to be packaged placed in the carton. The film may be inserted at any time during formation of the carton shown in FIG. 2, and may be, as an example, inserted prior to the final sealing (by the application of heat and pressure) of left hand seal areas 48. The glued together carton edges 48 form colpanar fins, with a plane containing the fins passing through the carton interior, as readily visualized from FIG. 3. These side fins meet with the ends of the top fin defined by top edge of panel 16 and panel 44, as shown at FIG. 4. The ends of the top fin bend towards the right and merge with the upper ends of the side fins, as viewed at FIG. 2, while the middle regions are straight. Triangular gusset regions 36 bend downwardly, as do score lines 37. It is seen that those adhesive (stippled) regions of border 48 of FIG. 1 immediately above and below score lines 37 fold towards each other in surface contact. The same folding action occurs with triangular gusset areas 24 of the bottom panel 22, although not shown, with regions of stippled border 48 of FIG. 1 immediately above and below score lines 26 also folding towards each other in surface contact. Thus the bottom ends of the carton are formed in the same manner as the top top ends regarding panels 34 and 22. It is seen that no raw edges of the gussets or other parts of the paperboard blank are exposed to the carton interior.

FIG. 4 illustrates how the package is opened to permit access to the film. Referring again to FIG. 2, it is seen that the upper fin areas above adhesive area 38 are not adhered together. The user places a fingernail between the upper free edge of panel 16 and the upper free edge of panel 44, pries them apart, and then pulls to tear open the package. This is indicated at FIG. 4 wherein adhesive area 38 is shown as stippled, aligned openings 40 and 42 located above this area, with upper regions 16 and 44 capable of being pulled apart, as indicated by the oppositely direct arrows. FIG. 4 also shows one of the two upper triangular portions 36, and one of the two lower triangular portions 24. The central interior vertical line in FIG. 4 represents the adhered together fin borders 48 of the carton.

Figure 5:
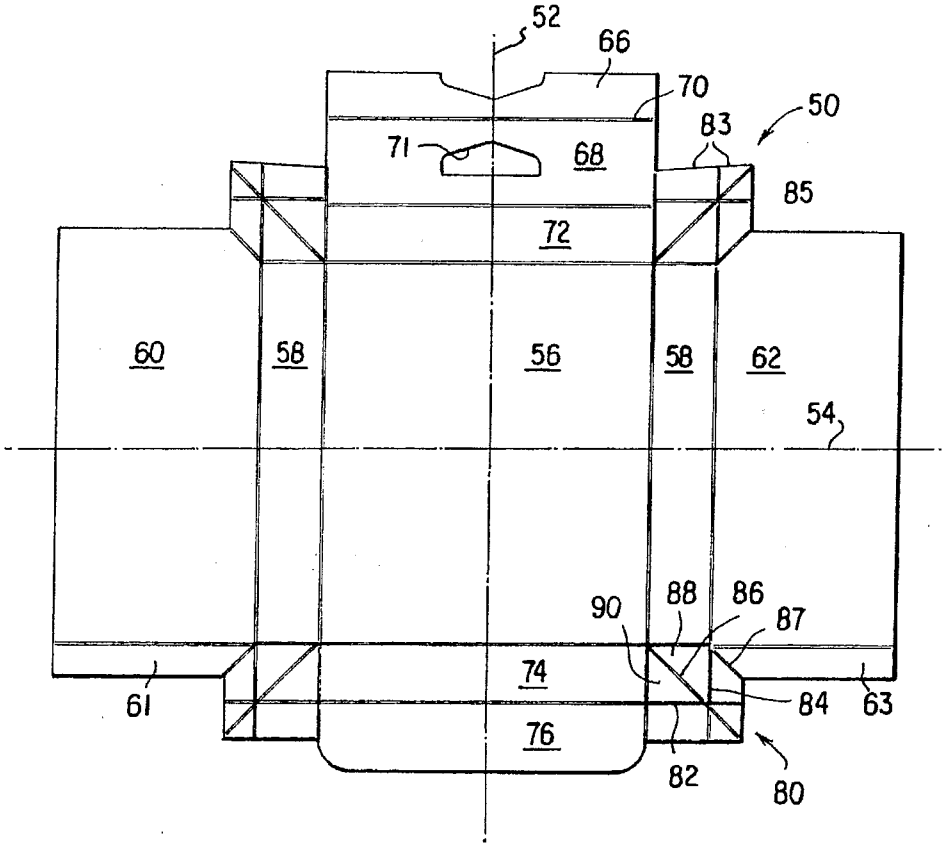
Figure 10:
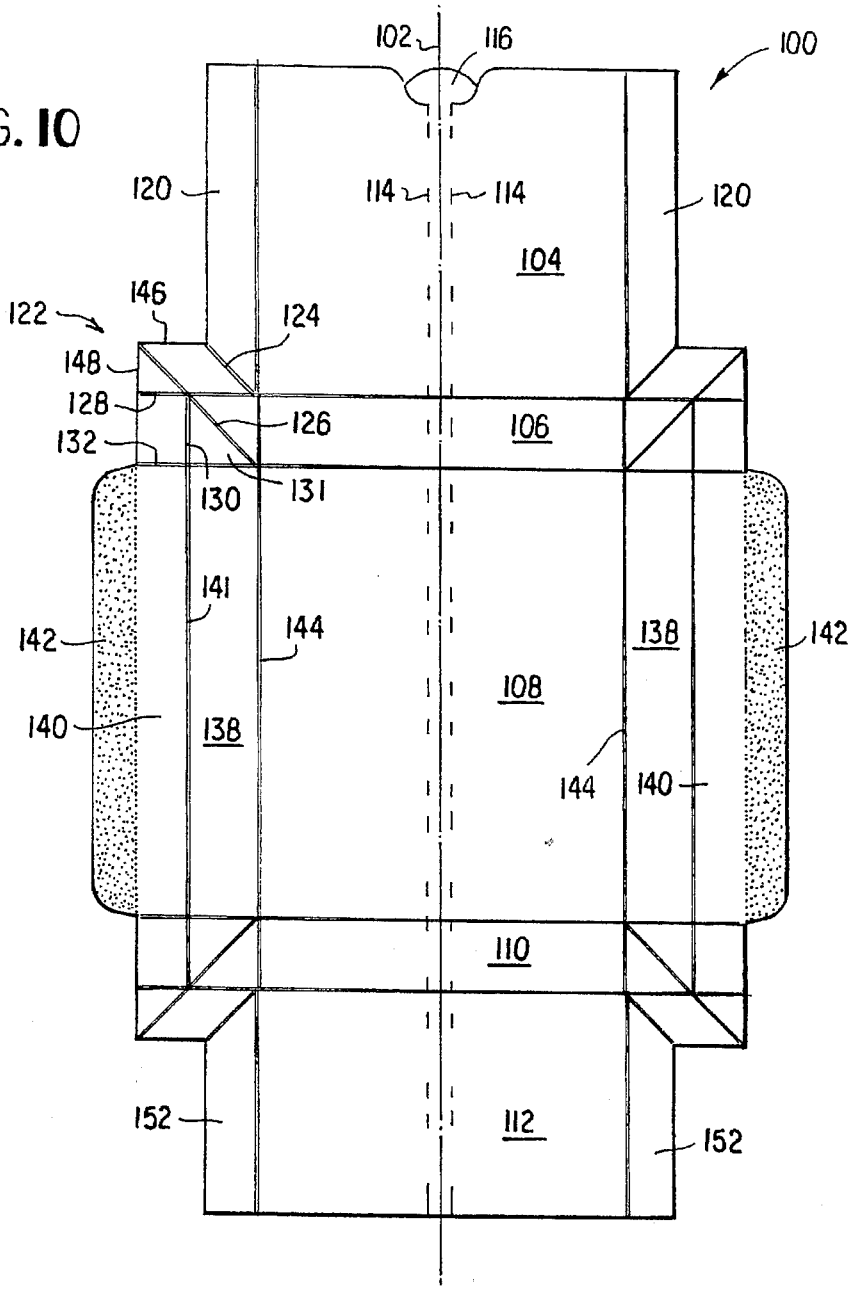
Figure 14:
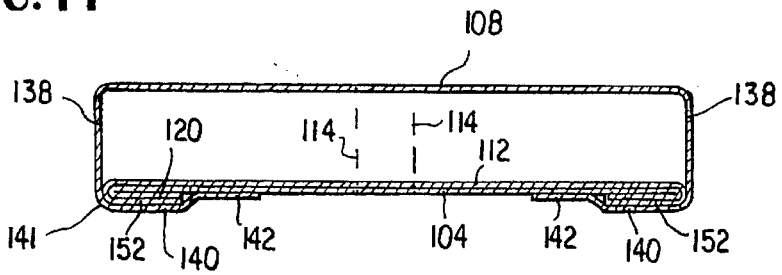

FIG. 5 illustrates a unitary paperboard blank 50 from which a carton according to a second modification of this invention is formed. A vertical axis 52 and a horizontal axis 54 are both shown. The blank is mirror symmetrical about vertical axis 52. Main central panel 56 is bordered on its left and right by respective vertically extending panels 58, while leftmost panel 60 is joined to the left panel 58, while right hand panel 62 is joined to the right-hand panel 58. Uppermost panel 66 is provided at its lower edge with horizontal score line 70, while the middle upper portion of panel 66 is provided with a cut partially congruent to opening 71 of next lower panel 68. In turn, panel 72 is between panel 68 and 56 as measured vertically. Lower panels 74 and 76 are located at the lower edge of panel 56. The four corners of panel 56 are each contiguous to a gusset formation 80, with fold lines 82, 86, and 87 defining gusset members 80. Adjacent triangles on either side of fold line 86 are denoted as 88 and 90. It will be understood that the construction of each of the gussets is identical. Blank 50 is in the general shape of a cross, with central panel 56 having upper and lower extensions each interrupted by horizontal score lines. The upper extensions (panels 66, 68, 72) are of a greater vertical extent than lower extensions 74, 76. Further, the vertical extent of panels 68 and 72 together is greater than the vertical extent of panels 74 and 76 together.

Figure 6:
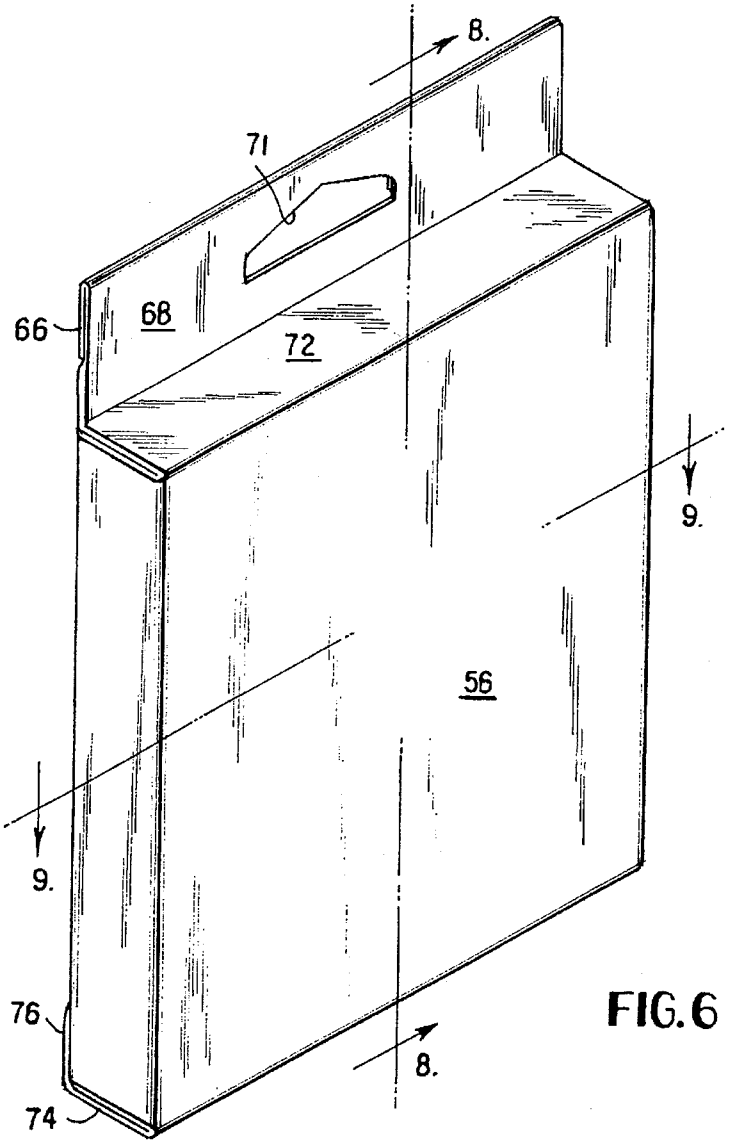

Referring now to FIGS. 6 and 7, a carton or container is fashioned from blank 50 by folding panels 60 and 62, as well as panels 58, about the indicated vertically running score lines, with lower panels 74 and 76 also folded about respective horizontally running score lines, as well as upper panel 66, 68, and 72. FIG. 7 illustrates the formation of the rear panel which is defined by partially overlapping panels 60 and 62. Corner gussets 80 are formed by folding about respective diagonal fold lines 86, with the upper two corners of the rear of the carton, shown at FIG. 7, defined by horizontal panel 72 folded at right angles to both panels 56 (not seen in FIG. 7) and panels 68. Panel 66 is folded rearwardly about horizontal fold line 70 and glued to the upper portion of panel 68. Similarly, panel 74 is folded to be at right angles with respect to panel 56 (not shown in FIG. 7) and panel 76. Panel 76 is glued to both an intermediate or middle portion of panel 74, with the upper part of panel 76, as viewed at FIG. 7, glued to rear panels 60 and 62. Hanging panel 68 extends vertically while top panel 72 is lies in a horizontal plane as does bottom panel 74.

The formation of the gusset structure is achieved by folding gussets 80 about slanted score lines 86. After folding, gussets 80 are at the four corners of the rear of the container as shown in FIG. 7. FIG. 7 also shows the free edges 83 and 85 of each of gussets 80. Lowermost border panels 61 and 63, at the bottom of the carton, are folded upwardly so as to be parallel with the plane of rear panels 60 and 62, with the folded gussets located between panels 61 and 63 and lowermost panel 76, the upper end of which is glued against the rear panel of the container. It is seen that a portion of each of the two upper corner gussets is folded (between 68 and 60,62) against an inner portion of the rear wall and that a portion of each of the lower corner gussets is folded (between 76 and 60,62) against an outer portion of the rear wall.

Referring now to FIGS. 10–14, a third embodiment of the carton for forming the package of this invention is shown. At FIG. 10, a unitary paperboard blank 100 exhibits mirror symmetry with respect to vertical axis 102. Upper panel 104 is joined to panel 106 through the indicated horizontal fold line, while panel 106 is joined to central panel 108, also by an indicated fold line. Panel 110 is joined by an indicated fold line to the bottom of panel 108, while panel 112 is joined to the bottom of panel 110 by an indicated fold line. Vertically extending and spaced score lines 114 denote the edges of a tear strip, the upper end of which is designated as 116 for manually grasping and opening the package. The four corners of central panels 108 are each provided with a gusset construction denoted generally as 122, the gusset construction including slanted score lines 124 and 126, horizontal score lines 128 and 132, and portions of vertical score lines 144.

To form the carton shown at FIG. 12 from blank 100, upper and lower panels 104 and 112, respectively, are folded about the indicated horizontal fold lines and their free ends overlapped and, again by heat and pressure, adhered together as shown at FIG. 13. Further, side panels 138 and 140 are folded about vertical score lines 141 and 144, with gussets 122 concurrently being folded about their respective fold lines 124 and 126. Panel 108 is termed the front wall or panel while partially overlapped panels 104 and 112 are termed the rear wall or panel of the carton.

FIG. 11 illustrates the inward bending of each gusset panel panel construction 122 as the carton side panels 138, 140, 141 are folded over to close the carton sides and glued to front wall 104,112. Score line 126 bends downwardly as viewed in FIG. 11 and inwardly towards the carton interior. Substantially all of those portions respectively to the left and to the right of score line 126 come into surface contact with each other. From the configuration of FIG. 11, panels 138, 140 and 142 are bent about score lines 144 and 141, with the stippled portions 142 of panels 140 being adhered to rear wall 104,112 as shown at FIG. 12. The gusset portions which include the raw paperboard edges are sandwiched between panels 140 and composite or aligned panels 120,152, as seen from FIG. 11. The section view of FIG. 14 does not include the several gusset panel elements. At each of the carton corners, free edges 146 and 148 of each gusset 122 are aligned with each other and with a respective free edge of partially overlapping side panels 120 and 152. The same manner of gusset inward folding thus occurs here as in the second embodiment shown at FIGS. 5–9. Those portions of each gusset which include the paperboard raw edges, such as raw edges 146 and 148, are seen to be folded onto the exterior surface of respective right and left edges of rear wall 104,112. The carton interior is thus not exposed to these raw edges.

To open the carton of FIG. 12, tab 116 is grasped and contiuously pulled outwardly and upwardly as indicated by the dashed lines and curved arrow of FIG. 13. Tear lines 114 then permit the carton to be ripped in half to gain access to the photographic film inside.

Geometrical terms of orientation such as lower, upper, and the like are used in the specicication and claims to facilitate the description.

I claim:

1. A unitary paperboard blank for forming a package for photographic film, said blank being coated with a thermoplastic barrier coating, said blank being generally rectangular and having upper and lower ends and vertically extending side edges, said blank having a vertical axis, a bottom forming panel extending substantially orthogonally to said vertical axis, said bottom forming panel being substantially midway of said vertical axis, a top forming panel generally at right angles to said vertical axis and located adjacent one end of said blank, a front wall forming panel located between said top forming and said bottom forming panels, a rear wall forming panel located above said bottom forming panel, said top forming and said bottom forming panels each having a pair of triangular areas defined by fold lines, each of said triangular areas being adjacent a respective said vertically extending side edge, each said triangular area having an apex which is aligned with and meets a respective horizontal fold line, the latter each extending from a respective vertically extending side edge to a respective triangular area apex, said top and bottom forming panels each defined by a respective pair of parallel and horizontally extending fold lines.

2. The blank of claim 1 including a vertical score line adjacent each said vertically extending side edge, each said vertically extending score line defining a vertical strip adapted to be sealed to the other vertical strip to form side fins when said blank is formed into a carton.

3. The blank of claim 1 wherein said blank has a lowermost free edge, and including a glue area below said top forming panel, said glue area extending between said vertically extending side edges of said blank, said glue area not extending to said lowermost free edge.

4. The blank of claim 3 including a central aperture between said glue area and said lowermost free edge, and including a central aperture located at an upper region of said rear wall forming panel, said central apertures adapted to be aligned when the blank is folded to form a carton.

5. A generally rectangular carton for forming a package of photographic film, said carton having an interior and formed from a unitary paperboard blank being coated with a thermoplastic barrier coating, said carton having sides, a top fin, a top panel having ends, and a bottom panel having ends, said carton having a rear panel and a front panel, said rear and front panels being parallel and spaced apart, said rear panel extending above said top panel, said sides of said carton having fins which are sealed together in parallel relationship to form respective side fins, said front panel, said top and bottom panels and said rear panel defining said interior of said carton, said top panel having an upwardly extending extension which is aligned with an upper portion of said rear panel to define said top fin, each of said top and bottom panels having triangular gussets at respective said ends, said gussets having portions which are folded and are a part of said respective side fins, said top fin having lower facing surfaces which are adhered together, whereby said top fin can be pried apart to open the carton.

6. The carton of claim 5 including an aperture through said top fin, said aperture located above said lower facing surfaces which are glued together.

* * * * *